US005487323A

United States Patent [19]

Madden, Jr.

[11] Patent Number: 5,487,323

[45] Date of Patent: Jan. 30, 1996

[54] REMOVABLE BULLET RESISTANT APPARATUS FOR VEHICLES

[76] Inventor: James R. Madden, Jr., 4410 W. Acoma Dr., Glendale, Ariz. 85306-4506

[21] Appl. No.: 375,720

[22] Filed: Jan. 20, 1995

[51] Int. Cl.[6] ..... F41H 5/26

[52] U.S. Cl. ..... 89/36.08; 89/36.14; 296/84.1

[58] Field of Search ..... 89/36.01, 36.08, 89/36.14; 296/84.1, 96.14, 97.7

[56] References Cited

U.S. PATENT DOCUMENTS

| | | | |
|---|---|---|---|
| 3,923,339 | 12/1975 | McDonald | 89/36.14 |
| 4,643,477 | 2/1987 | Kovatch | 89/36.14 |
| 4,759,581 | 7/1988 | McNamee | 296/97.7 |
| 5,307,725 | 5/1994 | Desmond et al. | 89/36.14 |

*Primary Examiner*—Stephen C. Bentley
*Attorney, Agent, or Firm*—H. Gordon Shields

[57] ABSTRACT

Removable bullet resistant apparatus for windshields and rear windows of a vehicle includes a transparent panel which is disposed against structural elements of a vehicle and a layered mat is secured to the bottom portion of the transparent panel and disposed on the dashboard deck in front of the transparent panel for the windshield embodiment, and behind the transparent panel and on the rear deck for the rear window embodiment. The transparent panels and the mats are bullet resistant. The layered mats are secured to the transparent panels in an overlapping relationship. The transparent panels and their mats may be easily installed and easily removed from the vehicle. The mats are made of layers of bullet resistant material, woven or nonwoven, or combinations of both woven and nonwoven materials.

24 Claims, 4 Drawing Sheets

REMOVABLE BULLET RESISTANT APPARATUS FOR VEHICLES

BACKGROUND OF THE INVENTION

1. Field of the Invention

This invention relates to vehicles and, more particularly, to apparatus for providing bullet resistant protection for front and rear windows of a vehicle and which apparatus is easily installed in a vehicle and is easily removed from the vehicle.

2. Description of the Prior Art

U.S. Pat. No. 1,443,708 (Fenton) discloses an armor system for a vehicle. The armor includes a plurality of holes, with glass elements covering some of the holes. The holes covered by glass elements comprise viewing apertures. Armor plate cover some of the holes from the interior. Some of the interior armor plate may be removed so that firearms may be used from the inside of the vehicle, shooting outwardly through the holes.

U.S. Pat. No. 1,913,554 (Luker) discloses a bulletproof covering for portions of a vehicle, including the radiator and tires. The bulletproof covering or armor is designed to protect the front end of a vehicle.

U.S. Pat. No. 2,363,573 (Costa) discloses what is referred to as an armor shell for a motor vehicle. Virtually the entire vehicle is covered with an armor shell. There are gun ports in the shell and viewing slits for observing outside the vehicle.

U.S. Pat. No. 3,855,898 (McDonald) discloses sheeting material applied to the interior of a vehicle. The sheeting includes transparent coverings for the windows and panels which extend over the doors. The door panels are preformed in a particular configuration and are permanently secured in place.

U.S. Pat. No. 4,316,404 (Medlin) discloses a lightweight armored vehicle and a method of making the lightweight armored vehicle. The disclosed method comprises stripping a vehicle interior, and using different types of bulletproof material for the interior of the vehicle and also for the gasoline tank of the vehicle.

U.S. Pat. No. 4,352,316 (Medlin) comprises a continuation-in-part patent of the '404 patent. It accordingly contains virtually the same method and apparatus, but with different materials involved.

The patents discussed in the preceding paragraphs all utilize a permanent installation of bulletproof or bullet resistant material in a vehicle. Accordingly, substantial changes are made in the vehicles to bulletproof them. The substantial changes include substantial costs involvement, as may be understood and expected.

U.S. Pat. Nos. 5,271,311 (Madden) and 5,370,035 (Madden), the inventor of which is the inventor of the present invention, disclose bullet resistant apparatus for the sides of a vehicle and bullet resistant partition apparatus for use behind the front seat of a vehicle. Both types of apparatus utilize transparent panels and flexible curtain elements secured to and extending below the transparent panels. The apparatus may be easily and quickly installed in a vehicle.

The apparatus of the present invention comprises relatively inexpensive bullet resistant apparatus which includes a transparent panel disposed adjacent to a window and against the top structure of a vehicle and biased against a deck structure. The deck structure includes either the dashboard portion of a vehicle adjacent to the front window or windshield, or the rear deck portion adjacent to the rear window. A layered mat is disposed on the deck and is secured to the transparent panel.

The embodiments of the apparatus of the present invention are disposed adjacent to the windshield and rear window areas to provide substantial protection from bullets fired from outside the vehicle toward the front and rear of the vehicle.

Protection is afforded to the driver and other passengers in the vehicle by employing a combination of transparent bullet resistant material and layers of bullet resistant fabric or fibrous material which may be easily installed and easily removed from the front and rear window areas of a vehicle.

SUMMARY OF THE INVENTION

Transparent bullet resistant material is placed adjacent to a window of a vehicle and secured between the top structure of the vehicle and a deck portion of the vehicle adjacent to the window. A layered mat of flexible, bullet resistant material, which may be woven or nonwoven, or a combination thereof, is secured to the transparent panel and extends from the transparent panel outwardly on the deck area between the transparent panel and the window. A front window or windshield embodiment includes a transparent panel extending between the top structure and the dashboard. A layered mat comprised of a plurality of layers of bullet resistant material is secured to the panel and is disposed on the dashboard area between the panel and the windshield as a type of ballistic dash cover. The rear window apparatus is similar in structure, utilizing both the transparent panel and the layered mat material, with the layered mat disposed on the rear deck and extending from the transparent panel to the rear window.

Among the objects of the present invention are the following:

- To provide new and useful removable bullet resistant apparatus for vehicles;
- To provide new and useful removable bullet resistant apparatus including transparent panels and mats of fibrous material secured to and extending outwardly from the transparent panels;
- To provide new and useful bullet resistant apparatus for a vehicle front window and a vehicle rear window which includes a panel of transparent material and fibrous material secured to the transparent panel and disposed adjacent to the respective windows;
- To provide new and useful removable bullet resistant apparatus for the front and rear windows of a vehicle and which apparatus may be relatively easily installed in and removed from a vehicle; and
- To provide new and useful bullet resistant apparatus for the front and rear windows of a vehicle which are braced against structural elements of the vehicle.

DESCRIPTION OF THE PREFERRED EMBODIMENT

Figure 1:
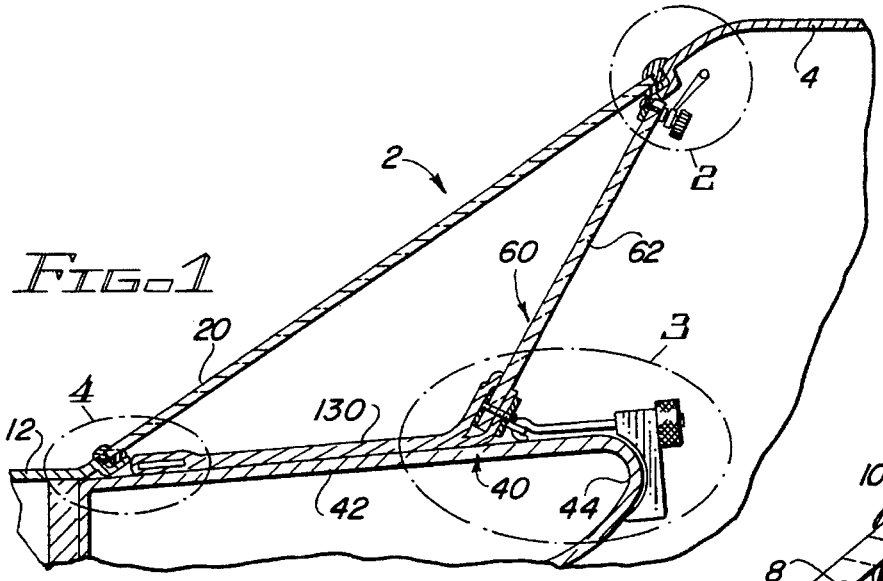
FIG. 1 is a side view in partial section illustrating a front window bullet resistant apparatus of the present invention in its use environment.

As indicated above, the present invention relates to bullet resistant elements disposed adjacent to a window and disposed on a deck area adjacent to the window, such as adjacent to both the front window and the rear window of a vehicle. The bullet resistant embodiments are very similar, differing primarily in the structure for supporting them in their respective environments. The embodiments both include a transparent bullet resistant panel and a bullet resistant layered mat extending outwardly from and secured to the transparent panel in an overlapping relationship. FIGS. 1–6 relate to the front window embodiment, and FIGS. 7–14 relate to three rear window embodiments.

The several embodiments are disposed within a vehicle 2. The embodiments for the vehicle 2 are indicated by reference numeral 60 for the front window (windshield) embodiment in FIGS. 1–6, and reference numerals 160, 260, and 310 for the rear window embodiments. For the following discussion of the front window embodiment 60, reference will primarily be made to FIGS. 1–6.

The vehicle 2 includes a vehicle top or roof structure 4 and a front window cowling or firewall structure 12, to which is secured a windshield 20. Extending inwardly within the vehicle 2 from the structure 12 is a deck area comprising a dashboard assembly 40. Details of the vehicle 2, the top or roof structure 4 and the cowling structure 12 and dashboard assembly 40 are illustrated in FIGS. 1, 2, 3, and 4, all of which comprise views in partial section.

Figure 2:
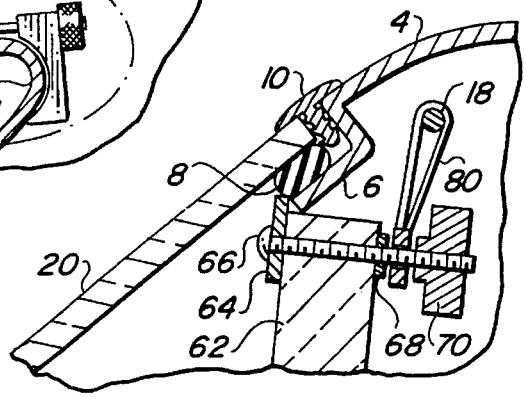
FIG. 2 is an enlarged view in partial section taken generally from Circle 2 of FIG. 1.

FIG. 2 is a view in partial section taken generally from circle 2 of FIG. 1, illustrating the apparatus 60 in relation to the top structure 4 and the windshield 20 of the vehicle 2.

Figure 3:
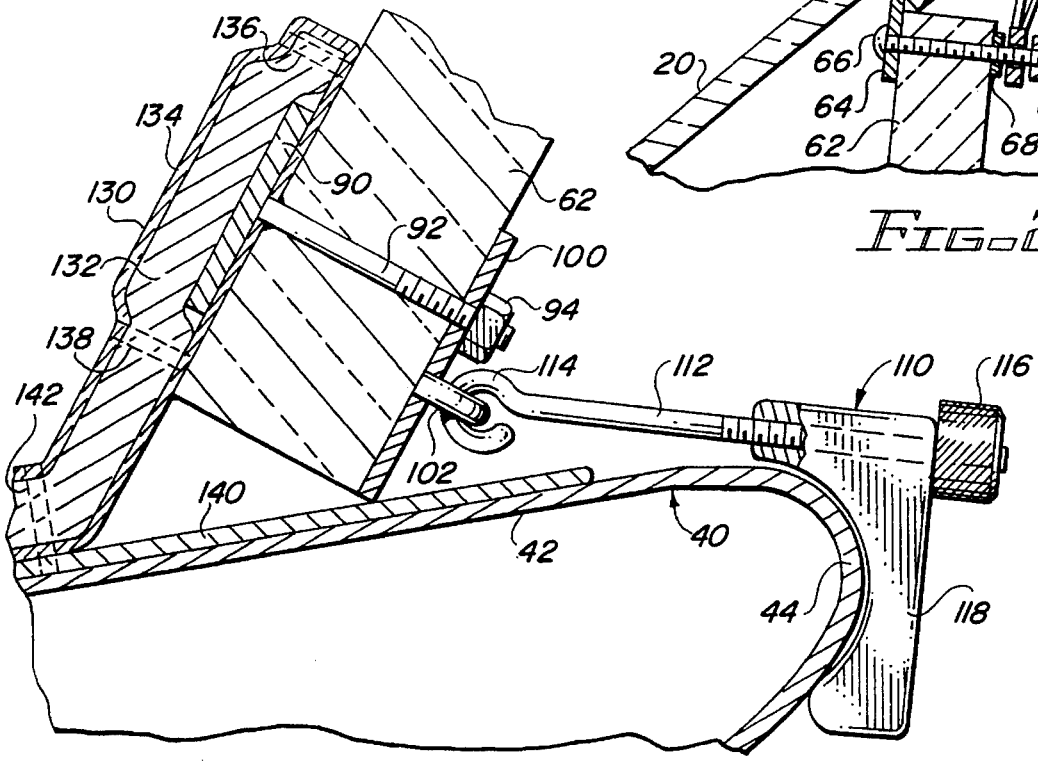
FIG. 3 is an enlarged view in partial section taken generally from Oval 3 of FIG. 1.

FIG. 3 is an enlarged view in partial section taken generally from oval 3 of FIG. 1, illustrating details of the relation of the apparatus 60 in relation to the dashboard assembly 40.

Figure 4:
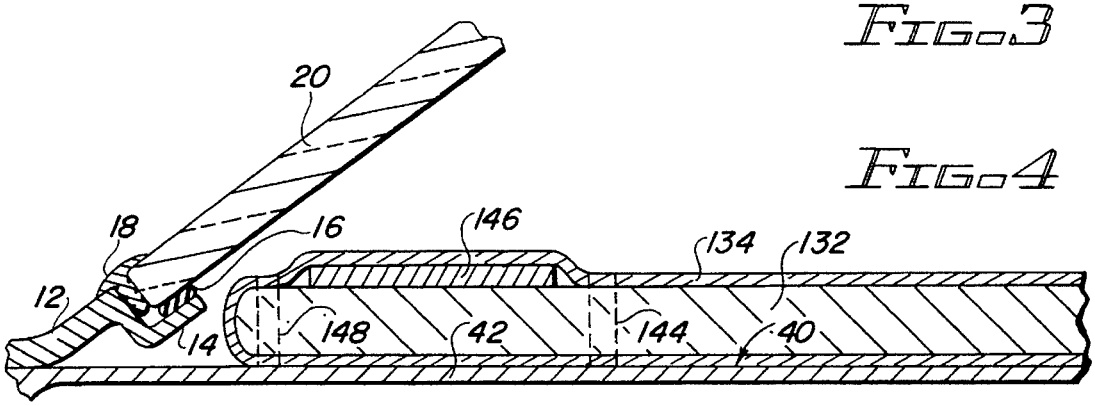
FIG. 4 is an enlarged view in partial section taken generally from Oval 4 of FIG. 1.

FIG. 4 is an enlarged view in partial section taken generally from oval 4 of FIG. 1, illustrating a portion of the apparatus 60 in relation of the bottom of the windshield 20 adjacent to both the cowling or front hood structure 12 and the dashboard assembly 40.

For the following discussion, reference will primarily be made to FIGS. 1–4.

The front window or windshield 20 is disposed on a lip or flange which extends about the windshield. The windshield is secured to the lip or flange by a ribbon of adhesive material which also extends entirely about the windshield. There is a space between the windshield on the lip or flange and the surrounding structure of the vehicle that is covered by a trim element. A top portion 6 of the lip or flange is shown in FIG. 2, along with a portion 8 of the adhesive ribbon. A top portion 10 of the trim element is also shown in FIG. 2. A bottom portion 14 of the offset lip or flange is shown in FIG. 4, along with a portion 16 of the adhesive ribbon. A bottom portion 18 of the decorative trim element is also shown in FIG. 4.

The lip or flange 14 is actually a continuation of the flange 6. Thus, the windshield 20 is secured by adhesive material which is disposed on a continuous flange all around the windshield.

The trim material, for example, may be a chromed or black metal or plastic strip which covers the space between the window 20 and the edge of the flange on which the windshield is disposed.

Figure 5:
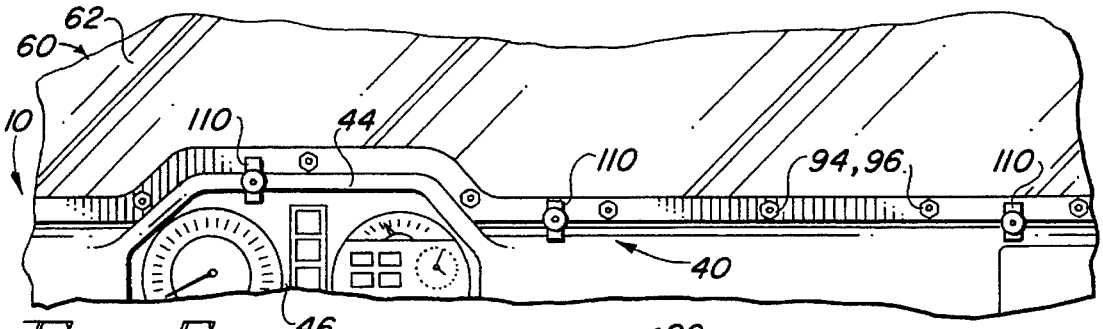
FIG. 5 is a front view of a portion of the apparatus of the present invention.
Figure 6:
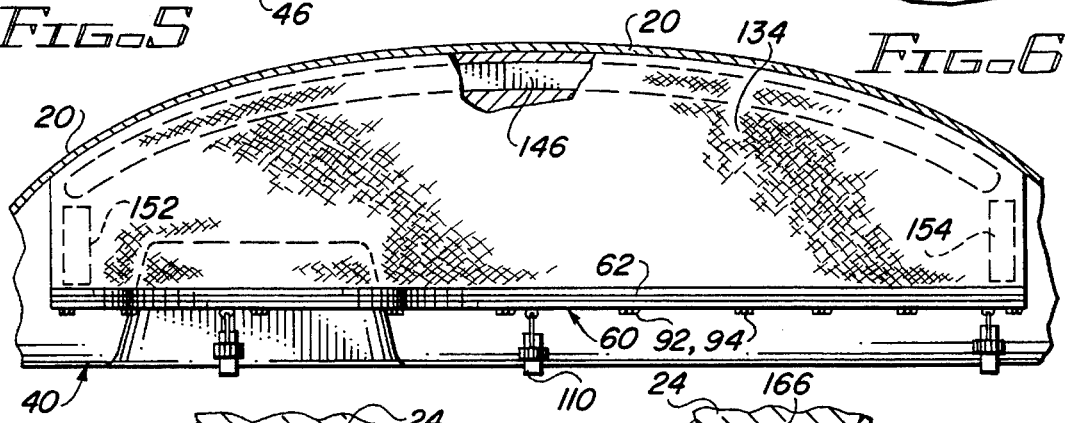
FIG. 6 is a top view of the apparatus of the present invention.

The dashboard assembly 40 includes a front rounded or convexly curved portion 44, best shown in FIG. 3. The dashboard assembly 40 extends the full width of the vehicle, as is well known and understood, and as is illustrated in FIGS. 5 and 6. An instrument panel 46 is disposed beneath the curved portion 44, as also shown in FIGS. 5 and 6.

The various structural elements of the vehicle 10, as illustrated in the figures of the drawing are, of course, merely exemplary. Vehicles differ in their construction, etc. Obviously, the apparatus of the present invention is appropriately configured to conform to the structural elements of the vehicles in which the apparatus is installed.

As shown in FIG. 1, the apparatus 60 includes two primary elements or assemblies, a bullet resistant transparent panel 62 and a bullet resistant layered mat assembly 130. As shown in FIG. 2, the bullet resistant transparent panel 62 includes a top tab 64. The top tab 64 is secured to the upper portion of the transparent panel 62 by an appropriate fastening element, such as a bolt 66. A washer 68 is disposed against the inside of the panel 62, remote from the tab 64. A knob 70 is used to secure the bolt 66 and the tab 64 to the panel 62.

Shown in FIG. 2 is a secondary backup fastening element 80 which is secured to the bolt 66 between the washer 68 and the knob 70. The element 80 is illustrated as a loop element disposed over a portion 22 of the sun visor bracket. The sun visor bracket is appropriately secured to the vehicle top structure 4, as is well known and understood.

The secondary or backup element 80 is preferably secured adjacent to where the sun visor bracket attaches to the structure 4. A pair of the secondary fastening elements 80 will, of course, be used, with one element at each side of the vehicle windshield.

The bullet resistant layered mat assembly 130 is secured to the lower portion of the transparent panel 62 in an overlapping arrangement or relationship. The transparent panel 62 is, as indicated, of bullet resistant material, and typically comprises a plurality of transparent panels laminated together, such as, for example, transparent laminate material marketed under the "LEXGARD" trademark of General Electric Company. The thickness of the panel 62 will vary in accordance with the degree of bullet resistant characteristics desired.

The layered mat assembly 130 includes multiple layers 132 of bullet resistant fibrous material or cloth, which may be woven or non-woven material, as indicated above, or combinations of both, and metal insert plates or bars. The woven and non-woven materials are made of fibers of different types. On such type of cloth, for example, may be of aramid or aromatic polyamide materials. Another type, for example, may be of polyethylene material with a flexible resin bonded between film layers in which two plys of unidirectional fiber are bonded together in a zero degree and 90 degree orientation between layers of film. There may also be woven cloth made of polyethylene fiber. Allied-Signal manufactures the polyethylene based materials under its "Spectra" and "Spectra Shield" trademarks. The "Kevlar" trademark is used in conjunction with bullet resistant materials made from aramid fibers manufactured by DuPont. Obviously, other bullet resistant cloth or fibrous materials may also be used.

The number of layers 132 of the bullet resistant fibrous material used, like the thickness of the transparent panel 62, depends on the degree of protection desired. The composition of the multiple layers 132 also depends on the degree of protection desired, and on other, well known and understood parameters.

The multiple layers 132 are enclosed in an outer covering 134, which is preferably of ballistic nylon. The use of ballistic nylon also provides some degree of bullet resistant protection.

The multiple layers 132, with the outer covering 134, are secured to the lower portion of the panel 62 by means of a bottom outer plate or bar 90. The bar 90 is secured to the multiple panels 132 through the outer covering 134 by stitching 136 and 138. The stitching 136 and 138 also helps to secure the outer covering 134 to the multiple layers 132.

A bolt 92 is appropriately secured, as by welding, to the outer bar 90. The bolt 92 extends through a hole or aperture in the panel 62. The bolt 92 also extends through an inner bar 100 and is secured to the bar 100 and to the panel 62 by means of a bolt 94.

Also secured to the bar 100 is a loop 102. The purpose of the loop 102 is to enable a front fastener clamp assembly 110 to be secured to the lower portion of the panel 62.

Also secured to the outer cover 134, and accordingly to the multiple layers 132, is an inner front bottom layer 140. The layer 140 is also preferably of ballistic nylon, substantially the same as the outer covering 134. The layer 140 is disposed on the top sloping portion 42 of the dashboard assembly 40 in front of the panel 62. The layer 140 comprises a cushion for the bottom of the panel 62 and the bar 100. This is shown in FIG. 3.

The bottom layer 140 is appropriately secured to the covering 134 and to the multiple layers 132 by stitching 142.

The front fastener clamp assembly 110 includes a threaded shank 112 to which is secured a hook 114. The hook 114 extends through the loop 102. The threaded shank 112 also extends through a front clamp element 118 and is secured thereto by a knob 116.

The front clamp element 118 includes a concave inner surface which matingly engages a convex outer curved surface 44 of the dashboard assembly 40.

With the tab 64 disposed against the bottom of the offset lip of the top structure 12 of the vehicle 10, tension is applied to the bottom of the panel 62 by means of the front clamp element 118 and the threaded shank 112. As the knob 116 is tightened on the shank 112, the bottom of the panel 62 is drawn inwardly towards the interior of the vehicle, and upwardly along the sloping portion 42 of the dashboard assembly 40. This increasing tension maintains the windshield apparatus 60 in place within the vehicle 10 by essentially compressing the apparatus 60 between the dashboard assembly 40 and the roof structure 12 of the vehicle 10.

The layered mat assembly 130 is disposed on the sloping portion 42 of the dashboard assembly 40, as indicated above. Remote from the panel 62, there is an outer portion disposed adjacent to the juncture of the windshield 20 with the front hood structure 30 of the vehicle. An outer bar 146 is disposed on the layers 132 and held thereto by means of the outer covering 134. As shown in FIG. 4, stitching 144 and 148 maintains the bar 146 in place on the multiple layers 132.

FIG. 5 comprises a front view of the interior of the vehicle 10, including the dashboard assembly 40, the instrument panel 46, and looking outwardly toward the front of the vehicle. FIG. 6 comprises a top view of the dashboard assembly 40 showing the apparatus 60 disposed thereon. In FIGS. 5 and 6, three front fastener clamps 110 are illustrated, and a plurality of bolts 92 with their nuts 94 are shown, which bolts and nuts secure the inner bar 100 to the transparent panel 62.

Figure 8:
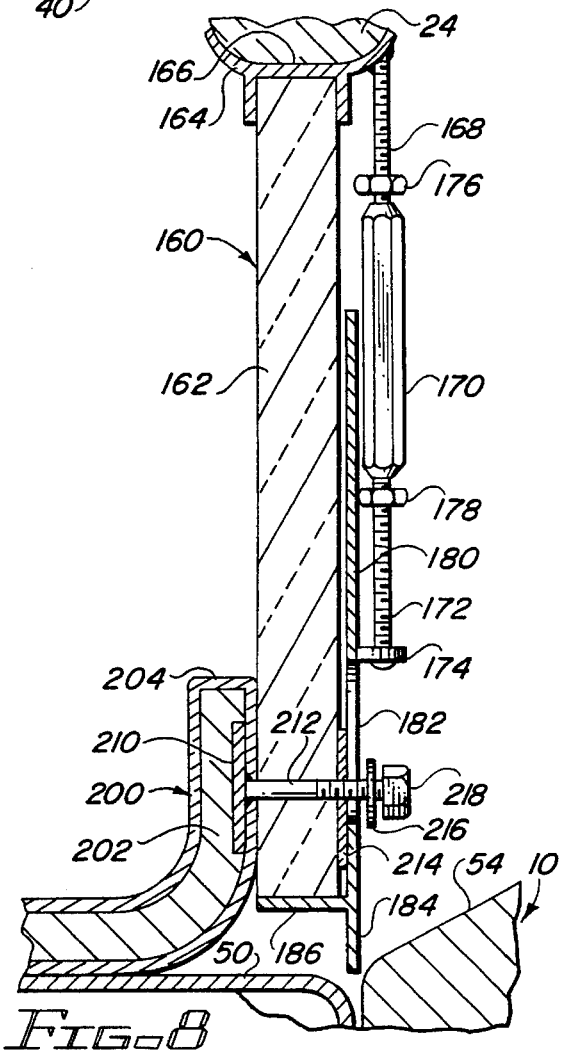
FIG. 8 is a side view in partial section illustrating the installation of the apparatus of FIG. 7.
Figure 9:
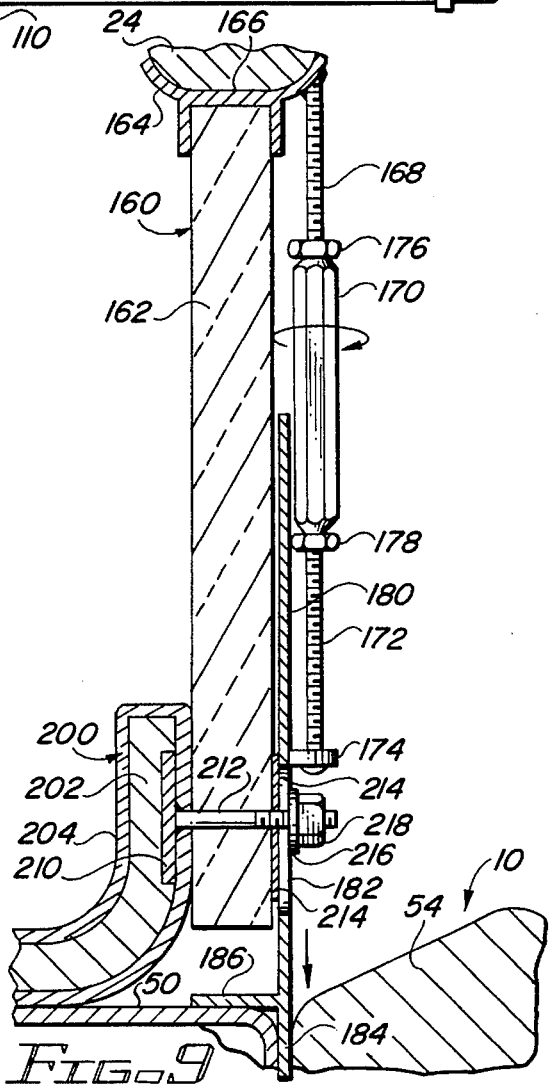
FIG. 9 is a side view sequentially following FIG. 8.
Figure 7:
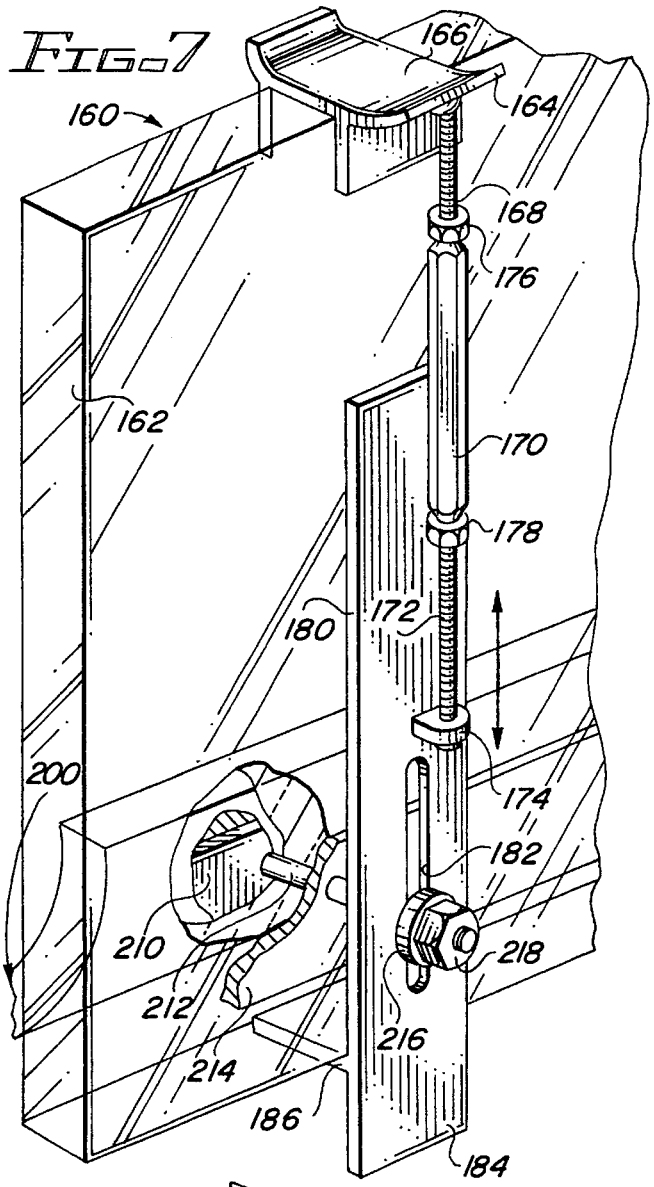
FIG. 7 is a perspective view of a portion of the bullet resistant rear window apparatus of the present invention.

The rear window embodiment 160 is illustrated in FIGS. 7, 8 and 9. FIG. 7 comprises a perspective view, partially broken away, of a portion of the apparatus 160. FIGS. 8 and 9 comprise views in partial section through the rear window embodiment 160 illustrating sequentially the installation of the embodiment 160 at the rear of a vehicle. The vehicle includes a rear window deck 50 and a rear seat or seatback 52.

The rear window embodiment 160 includes a bullet resistant transparent panel 162 which is disposed between a portion 24 of the top or roof structure 4 of the vehicle 2 and a space between the rear deck 50 and the rear seatback 52. Secured to the transparent panel 162 is a bullet resistant layered mat assembly 200, which is disposed on the rear window deck 50.

For the following discussion, reference will primarily be made to FIGS. 7, 8 and 9.

There is a bracket 164 secured to the top of the transparent panel 162. The bracket 164 includes a concave portion 166 which receives a portion 24 of the top or roof structure 4. Thus, the embodiment 160, and specifically the transparent panel 162, is braced against the roof structure 4 at the top of the transparent panel 162.

A threaded rod 168 is appropriately secured to the bracket 164. The threaded rod 168 extends downwardly from the bracket 164 to a turnbuckle 170. At the bottom of the turnbuckle 170 is another threaded rod 172. The threaded rod 172 is appropriately secured to a bracket 174. The bracket 174 is in turn secured to a plate 180. The plate 180 is movable relative to the transparent panel 162 to secure the panel 162, and accordingly the apparatus 160, to the vehicle between the rear deck 50 and the seat back 54.

The plate 180 includes a vertically extending slot 182, which will be discussed in detail below. At the bottom of the plate 182 is a downwardly extending flange 148. The flange 184 extends below a bottom shoulder flange 186. The flange 186 is generally perpendicular to the plate 180. With the plate 180 in its "up" position, the bottom of the transparent panel 160 is disposed against the flange 186. Or, phrased in the opposite manner, when the plate 180 is in its upper position, in response to rotation of the turnbuckle 170, the flange 186 is disposed against the bottom of the transparent panel 162. With the plate 180 in its "up" position, the apparatus 160 is ready for installation in a vehicle.

The layered mat assembly 200 is appropriately secured to the lower portion of the transparent panel 162 in an overlapping manner, very similar to that shown in FIGS. 1 and 3 for the apparatus 60. The layered mat assembly 200 includes multiple layers 202 of bullet resistant material, substantially the same as the multiple layers 132 discussed above in detail. That is, the multiple layers 202 may comprise multiple layers of either a single type of bullet resistant fibrous material or multiple layers of alternating types or other combinations of types of material, woven, nonwoven, etc. The multiple layers 202 are disposed within an outer covering 204, which outer covering is substantially the same as the outer covering 134 discussed above.

The layered mat 200 is secured to the transparent panel 162 by means of a bolt 212 which is appropriately secured to a bar or plate 210. The bar or plate 210 is appropriately stitched between the multiple layers 200 and the rear portion of the covering 204, again as discussed above with respect to the bar or plate 90 and its bolt 92.

The bolt 212 extends through a backing plate 214 and through the slot 182 in the plate 180. The slot 182 is dimensioned, width wise, to allow the bolt 212 to extend through the slot. A washer 216 is disposed on the bolt 212 outwardly from the plate 180, and a nut 218 is in turn secured to the bolt 212 outwardly from the washer 216. In FIG. 8, the washer 216 and the nut 218 are shown spaced apart from the plate 180 and the slot 182.

The backing plate 214 is disposed against the panel 162 remote from the curtain 200. The backing plate 214 also comprises a spacer plate for the plate 180 and its associated elements relative to the transparent, bullet resistant panel 162.

By rotating the turnbuckle 170, the plate 180 is moved upwardly and downwardly, as is well known and understood with respect to turnbuckle elements.

Rotation of the turnbuckle 170 in the direction indicated by the large curved arrow in FIG. 9, the plate 180 moves downwardly until the bottom flange 184 extends between the deck 50 and the seat 54 and the flange 186 is disposed on the deck 50. At such time as the flange 186 is disposed on the deck 50, the nut 218 is appropriately tightened on the bolt 212. The washer 216 moves with the nut 218 and the nut 218 locks the plate 180 in place, with the flanges 184 and 186 disposed as illustrated in FIG. 9. The rear window apparatus 160 is accordingly held in place by a biasing force and is locked in place between structural elements of the vehicle 10 in which the apparatus 160 is disposed.

Lock nuts 176 and 178 are shown spaced apart from the turnbuckle 170 in FIG. 8. The nuts 176 and 178 are shown disposed against the top and bottom, respectively, of the turnbuckle 170 in FIGS. 7 and 9. The nuts lock the turnbuckle 170 in place. There is thus essentially a double locking system for securing the apparatus 160 in place.

The layered mat assembly 200 extends on the deck 50 rearwardly to essentially cover the entire rear deck assembly adjacent to the rear window, while the transparent bullet resistant panel 162 extends fully between the walls of the vehicle 10, thus providing bullet resistant protection from the rear of the vehicle for the occupants of the vehicle.

Figure 11:
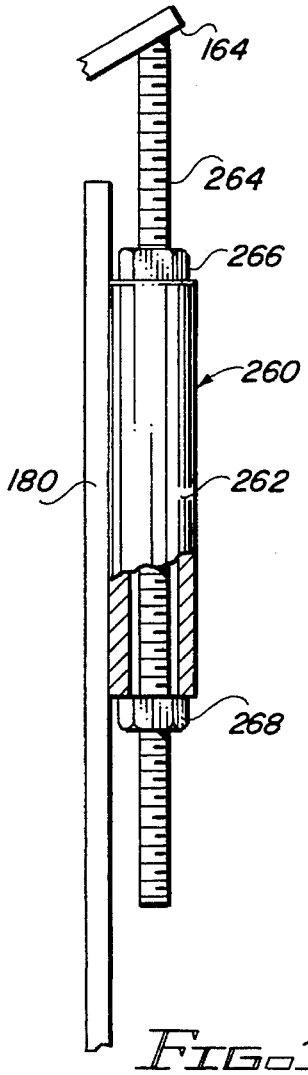
FIG. 11 is a side view of a portion of an alternate embodiment of the apparatus of FIGS. 7, 8, and 9.
Figure 10:
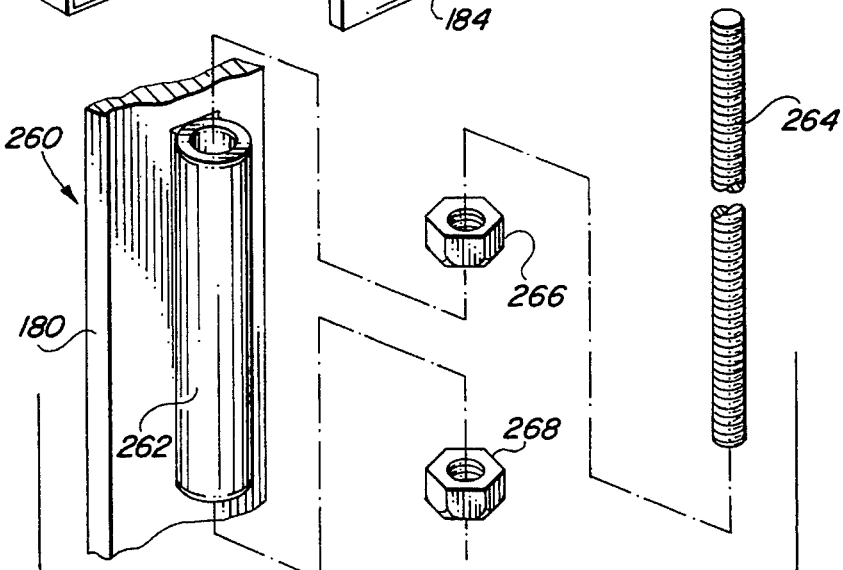
FIG. 10 is an exploded perspective view of a portion of an alternate embodiment of the apparatus of FIG. 10.

FIG. 10 is an exploded perspective view of the alternate rear window embodiment 260. FIG. 11 is a side view of the embodiment 260. For the following discussion, reference will primarily be made to FIGS. 10 and 11. However, since the environment of the embodiment 260 includes the plate 180 and the top bracket 164, reference may also conveniently be made to FIG. 7.

The rear window embodiment 260 includes a cylindrical sleeve 262 secured to the plate 180. The sleeve 262 is secured to the plate 180 above the slot 182 through which a portion of the bolt 212 extends.

A threaded rod 264 is appropriately secured to the bracket 164 and extends through the sleeve 262. A jam nut or lock nut 266 is disposed on the threaded rod 264 above the sleeve 262. A second jam nut or lock nut 268 is disposed on the threaded rod 264 below the sleeve 262.

For moving the plate 180, for purposes discussed in detail above, in addition to loosening the nut 218, one of the nuts 266 or 268 is loosened, and the other nut is appropriately rotated on the threaded rod 264. When the plate 180 has been appropriately positioned, the other nut is then tightened to lock the sleeve 262, and accordingly the plate 180, in place. The nut 218 is also tightened, as discussed above.

For example, if it is desired to move the plate 180 upwardly, the nut 266 is moved upwardly on the threaded rod 264. The lower nut 268 is then moved upwardly by rotating it on the rod 264 to press against the sleeve 262 to move the sleeve 262 and the plate 180 upwardly. When the plate 180 is in its desired upward location, the nut 266 is moved downwardly against the top of the sleeve 262.

The reverse is accomplished to move the plate 180 downwardly. The nut 268 is moved downwardly on the threaded rod 264 and the nut 266 is rotated on the rod 264 to move the sleeve 262 and the plate 180 downwardly. When the plate 180 is move downwardly to its desired location, the nut 268 is then moved upwardly on the threaded rod 264 until it is disposed against the bottom of the sleeve 262.

An inherent advantage of the embodiment 260 over the embodiment 160 is that only a single threaded rod is required. For the embodiment 160, the use of the turnbuckle 170 requires two different threaded rods 168 and 172, one threaded rod with right handed threads and the other threaded rod with left handed threads. Moreover, the lock nuts 176 and 178 used to lock the turnbuckle 170 in place requires a nut with right handed threads and a nut with left handed threads.

Both embodiments, whether the turn buckle embodiment or the sleeve embodiment, provide sufficient compressive force to hold the bullet resistant transparent panel 162, and accordingly also the bullet resistant layered mat assembly 200, in place adjacent to the rear window of a vehicle.

The bullet resistant layered mat assemblies 130 and 200 are substantially identical in fabrication. The mat assemblies comprise a plurality of layers of bullet resistant material, either woven of appropriate fiber material, such as aramid fibers, or polyethylene fibers, or the like, or nonwoven material, such as nonwoven polyethylene fibers, discussed above, or a combination of both woven and nonwoven bullet resistant materials, as desired. A covering is used for the layers to help hold them in place. The covering is preferably of ballistic nylon material, as indicated.

The bullet resistant transparent panels 62 and 162 allow a vehicle occupant to see or view through them, but they resist penetration by a bullet, as discussed above. As also discussed, the transparent panels may vary in thickness or in specific configuration, depending on the desired degree of bullet penetration protection. Similarly, the layered mat material may vary in thickness, or in the number of layers, depending on the degree of protection desired.

Figure 12:
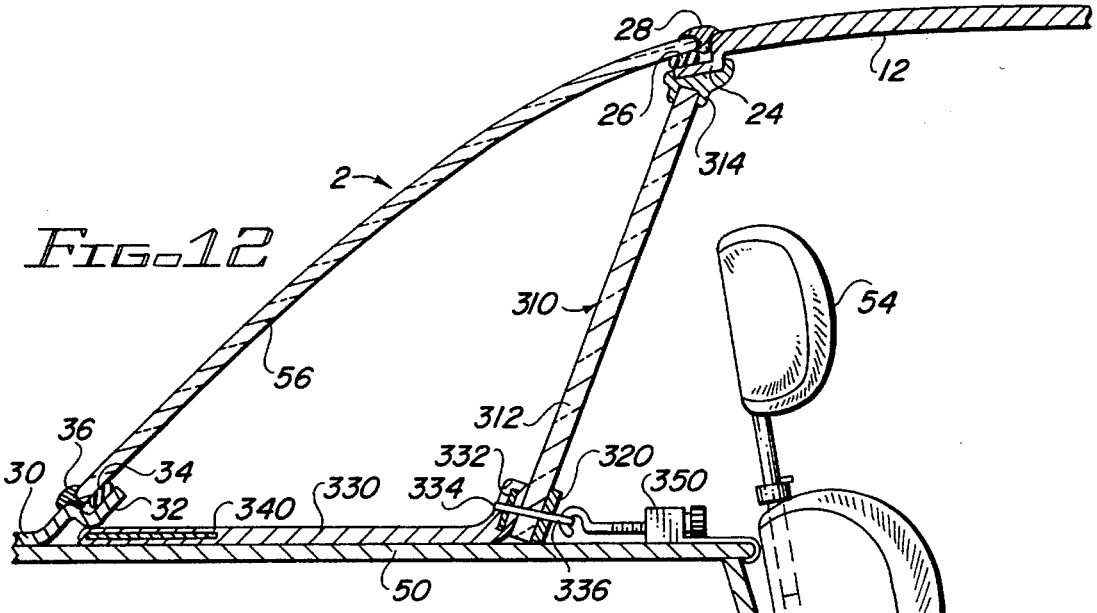
FIG. 12 is a view in partial section through an alternate embodiment of a rear window apparatus.

FIG. 12 is a view in partial section through the rear of the vehicle 2, with the rear deck 50 and the rear seat or seat back 52 shown.

Extending upwardly from the rear seat 52 is a head rest 54. The rear window deck 50 essentially extends from the rear seat 52 rearwardly to a rear portion 30 of the vehicle structure. A rear window 56 is secured to the vehicle 2.

The installation of the rear window 56 is substantially identical to the installation of the windshield 20, discussed above. The rear window 20 is disposed on an offset lip or flange which extends entirely around the rear window 56. Two portions of the flange are shown in FIG. 12, including the upper portion 24 and a lower portion 32.

The rear window 56 is held on the flange by a ribbon of adhesive material. Two portions of the adhesive material are shown, including an upper portion 26 and a lower portion 34.

Figure 13B:
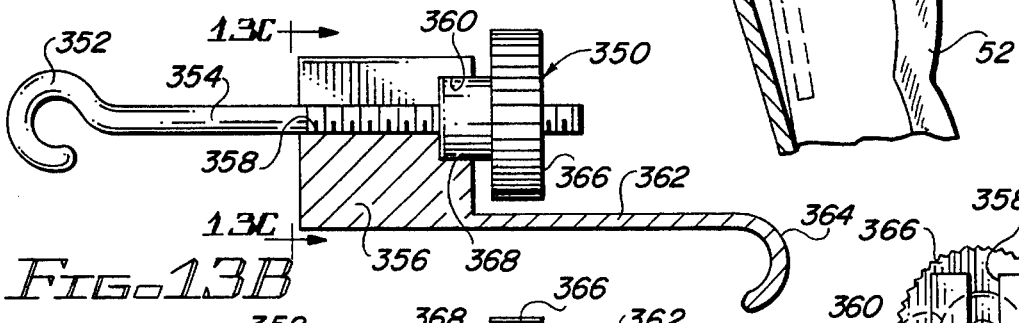
FIG. 13B is a side view in partial section taken generally along line 13B—13B of FIG. 13A.
Figure 13A:
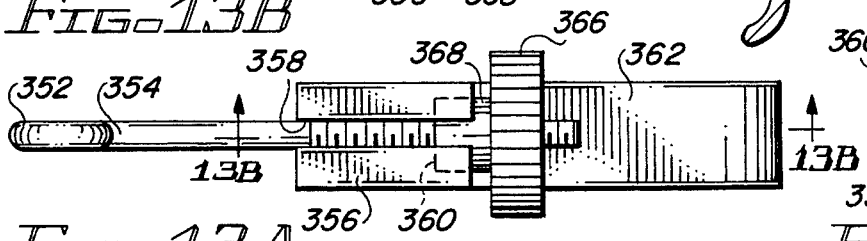
FIG. 13A is a top view of a portion of the apparatus of FIG. 12.
Figure 13C:
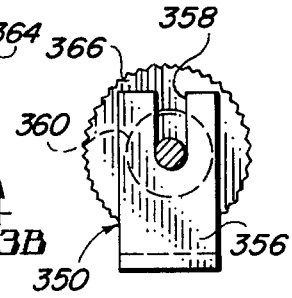
FIG. 13C is a view in partial section taken generally along line 13C—13C of FIG. 13B.
Figure 14:
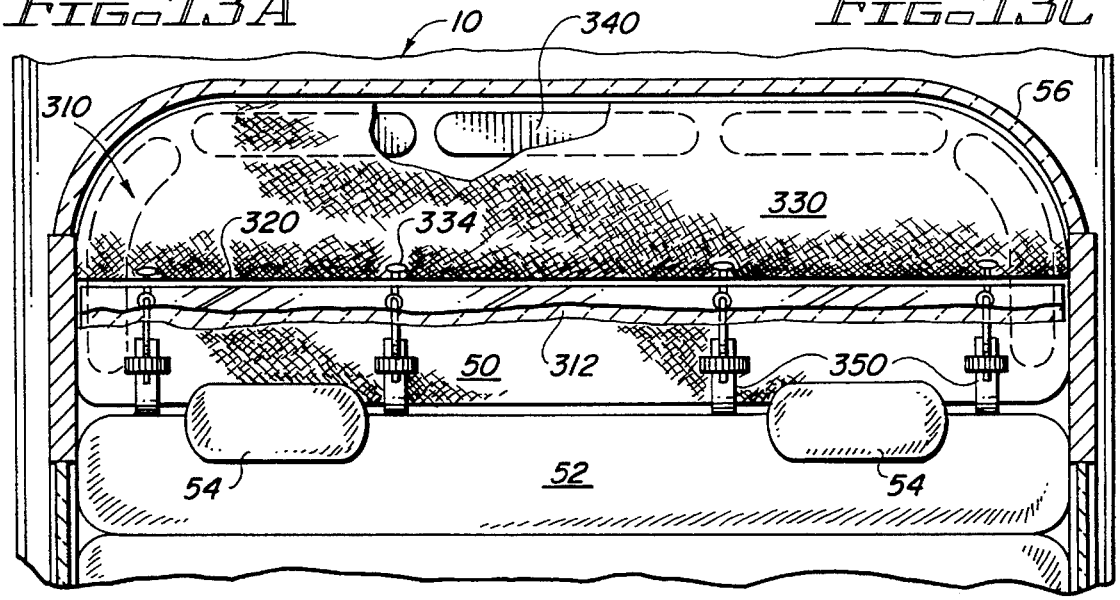
FIG. 14 is a top view of the apparatus of FIG. 12.

Another alternate embodiment, a rear window embodiment 310 is shown in FIGS. 12, 13A, 13B, 13C, and 14. FIG. 13 is a side view in partial section and FIG. 14 is a top view of the apparatus of FIG. 12 and of the adjacent vehicle structure. FIGS. 13A, 13B, and 13C are three views of a portion of the apparatus 310. For the following discussion, reference will primarily be made to FIGS. 12 and 14.

The rear window embodiment 310 includes a transparent bullet resistant panel 312 and a bullet resistant layered mat 330 secured to the lower portion of the panel 312 and extending from the panel 312 to the lower portion of the rear window 56. A clamp 350 is shown in FIG. 12 extending from the lower portion of the transparent panel 312, and an upper portion of the layered mat 330, to adjacent to the seat back 54 and clamped over the front end of the rear window deck 50.

FIGS. 13A, 13B, and 13C disclose details of the clamp 350. A plurality of clamps 350 is shown in FIG. 14. The clamp 350 will be discussed in detail below, and reference will primarily be made to those Figures.

Disposed at the top or upper portion of the transparent panel 312 is a top bracket 314. The top bracket 314 includes a concave portion which receives a portion of the vehicle top or roof structure, including the headliner (not shown). For convenience, only the top portion 24 of the flange or lip on which the rear window 56 is disposed is shown relative to the bracket 314. The bracket 314 accordingly is braced against the structural elements of the vehicle 2.

The bullet resistant layered mat 330 is substantially the same as the bullet resistant layered mat 200, discussed in detail above. The layered mat 330 includes an outer covering (not shown), a plate 332, and a plurality of fastener elements 334, such as eye bolts, which are appropriately secured to the plate 332 and to the layered mat 330. The fastener elements extend through the lower portion of the panel 312 and through an outer plate 320. The fastener elements secure the layered mat 330 to the panel 312 in an overlapping arrangement.

The outer plate 320 comprises a bottom plate for the panel 312. The fastener 334 includes a loop or eye 336 which receives a hook 352 of the clamp 350.

The clamp 350 includes a rod extending from the plate 320 to a block 356. The rod includes the hook 352. The rod also includes a threaded shank 354. The shank 354 extends through the block 356. From the bottom of the block 356 a plate 362 extends outwardly, or in the opposite direction from the shank 354. At the outer or distal end of the plate 362, remote from the block 356, is a hook portion 364. The hook portion 364 is disposed over the edge of the deck 350 adjacent to the seat back 354.

The block 356 includes a slot 358 which receives the shank 354. Extending into the block 356 is a bore 360. The bore 360 is on the opposite side of the block 356 from the hook 352. A knob 366 threadedly engages the shank 354. The knob 366 includes a rear boss 368 which extends into the bore 360. The boss 368, as disposed in the bore 360, prevents the rod, and specifically the threaded shank 354, from moving upwardly through the slot 358 and thus from coming loose.

As the knob 366 is tightened, tension is applied to the bottom of the panel 312 to pull the bottom 312 forwardly, towards the seat back 52. The increased tension accordingly urges the upper portion of the panel 312, namely the bracket 314, into engagement with the roof structure of the vehicle 2. The apparatus 310 is accordingly held in place on the rear deck area 350 of the vehicle 10.

A plurality of outer plates 340, best shown in FIG. 14, is disposed at the outer periphery of the layered mat 330 to help the layered mat 330 in place on the deck 50. As again best shown in FIG. 14, the sides of the layered mat 330 require curved plates so as to follow the curved configuration of the rear window 56 and of the rear window deck 50.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Bullet resistant apparatus for a vehicle having a top structure, a window cowling assembly, a front windshield disposed between the top structure and the window cowling assembly, and a dashboard assembly, comprising in combination;

a bullet resistant transparent panel secured to the vehicle between the top structure and the dashboard assembly; and a plurality of layers of bullet resistant material secured to the transparent panel and disposed on the dashboard assembly between the transparent panel and the front windshield.

2. The apparatus of claim 1 which further includes means for securing the transparent panel to the vehicle.

3. The apparatus of claim 2 in which the means for securing the transparent panel to the vehicle includes a tab secured to the transparent panel and disposed against the top structure of the vehicle.

4. The apparatus of claim 3 in which the means for securing the transparent panel to the vehicle further includes means for securing the transparent panel to the dashboard assembly.

5. The apparatus of claim 4 in which the means for securing the transparent panel to the dashboard assembly includes a rod secured to the transparent panel, a clamp secured to the dashboard assembly, and means for securing the rod to the clamp.

6. The apparatus of claim 2 in which the means for securing the transparent panel to the vehicle includes means for securing the transparent panel to the top structure of the vehicle, and means for securing the transparent panel to the dashboard assembly of the vehicle.

7. The apparatus of claim 6 in which the means for securing the transparent panel to the vehicle includes a top tab disposed against the top structure of the vehicle.

8. The apparatus of claim 6 in which the means for securing the transparent panel to the dashboard assembly of the vehicle includes a plate secured to the transparent panel, a rod secured to the plate, a clamp element secured to the dashboard assembly, and means for securing the rod to the clamp element.

9. The apparatus of claim 1 which further includes a plurality of plates secured to the plurality of layers of bullet resistant material.

10. Bullet resistant apparatus for a vehicle having a window, structural elements to which the window is secured, including top and bottom structures, and a deck structure extending into the vehicle from the window, comprising in combination:

a bullet resistant transparent panel disposed against the top structure of the vehicle;

a bullet resistant layered mat comprising a plurality of layers of bullet resistant material secured to the transparent panel and disposed on the deck structure of the vehicle; and means for securing the transparent panel and layered mat to the deck structure.

11. The apparatus of claim 10 in which the transparent panel includes a top portion and a bottom portion, and the layered mat is secured to the bottom portion.

12. The apparatus of claim 10 in which the means for securing the transparent panel and layered mat to the deck structure includes a threaded rod for applying tension to the transparent panel to urge the transparent panel against the top structure and the deck structure.

13. The apparatus of claim 10 in which the means for securing the transparent panel and layered mat to the deck structure includes a top bracket secured to the transparent panel, a plate secured to the transparent panel remote from the top bracket, and means for moving the plate relative to the top bracket and against the deck structure.

14. The apparatus of claim 13 in which the transparent panel includes a top portion and a bottom portion, and the top bracket is secured to the top portion and the plate is secured to the bottom portion.

15. The apparatus of claim 14 in which the means for moving the plate relative to the top structure includes a sleeve secured to the plate, a threaded rod secured to the top bracket and extending through the sleeve, and nuts secured to the rod and movable on the rod for moving the sleeve and the plate relative to the rod.

16. The apparatus of claim 13 in which the means for moving the plate relative to the top structure includes a turnbuckle, a first threaded rod secured to the top bracket and the turnbuckle, a second threaded rod secured to the plate, and the turnbuckle is rotatable on the two rods for moving the plate.

17. Bullet resistant apparatus for a vehicle having a rear window, top structure, rear deck, and back seat, comprising in combination:

a bullet resistant transparent panel disposed between the top structure and the rear deck;

a bullet resistant layered mat including a plurality of layers of bullet resistant material secured to the transparent panel and disposed on the rear deck; and means for securing the transparent panel to the top structure and the rear deck.

18. The apparatus of claim 17 in which the means for securing the transparent panel to the top structure and the rear deck includes a top bracket secured to the transparent panel and disposed against the top structure of the vehicle, a plate movably secured to the transparent panel and having a first flange to be disposed between the rear deck and the back seat and a second flange to be disposed on the rear deck, and means for moving the plate relative to the transparent panel to move the first flange between the rear seat and the rear deck and to move the second flange on the rear deck.

19. The apparatus of claim 18 in which the means for securing the transparent panel to the top structure further includes a bolt secured to the transparent panel and securable to the plate.

20. The apparatus of claim 19 in which the plate includes a slot through which the bolt extends for securing the plate to the transparent panel.

21. The apparatus of claim 19 in which the means for moving the plate relative to the transparent panel includes a sleeve secured to the plate, a threaded rod secured to the top bracket and extending through the sleeve, a first nut disposed on the threaded rod above the sleeve, and a second nut disposed on the threaded rod below the sleeve, whereby rotation of the first and second nuts moves the sleeve and the plate.

22. The apparatus of claim 19 in which the means for moving the plate relative to the transparent panel includes a first threaded rod secured to the top bracket, a second threaded rod secured to the plate, and a turnbuckle rotatably secured to both the first and second threaded rods whereby rotation of the turnbuckle moves the plate upwardly and downwardly relative to the transparent panel.

23. The apparatus of claim 17 in which the means for securing the transparent panel to the top structure and the rear deck includes a bracket disposed against the top structure, and a clamp secured to the transparent panel remote from the bracket and to the deck adjacent to the back seat.

24. The apparatus of claim 23 in which the clamp includes a block, a rod secured to the transparent panel and extending to the block, a hook secured to the block and disposed against the deck adjacent to the back seat, and means for securing the rod to the block to apply tension on the transparent panel to urge the transparent panel against the top structure and the rear deck.

* * * * *